United States Patent [19]

Nilsen, Morten N.

[11] Patent Number: 4,882,815

[45] Date of Patent: Nov. 28, 1989

[54] ARRANGEMENT IN A PURSE OR BAG SECURED AGAINST THEFT

[76] Inventor: Nilsen, Morten N., Bel Colles Allé 8A, DK-2960 Rungsted Kyst, Denmark

[21] Appl. No.: 201,139

[22] PCT Filed: Sep. 23, 1987

[86] PCT No.: PCT/NO87/00062

§ 371 Date: May 31, 1988

§ 102(e) Date: May 31, 1988

[87] PCT Pub. No.: WO88/02526

PCT Pub. Date: Apr. 7, 1988

Related U.S. Application Data

[63] Continuation of Ser. No. 752,967, Jul. 5, 1985, abandoned.

[30] Foreign Application Priority Data

Sep. 30, 1986 [NO] Norway ..... 863893

[51] Int. Cl.[4] ..... A44B 21/00; E05C 19/16

[52] U.S. Cl. ..... 24/303; 292/251.5; 335/285

[58] Field of Search ..... 24/303, 3 R, 3 H, 49 M; 292/251.5; 340/572, 546; 150/134; 335/285

[56] References Cited

U.S. PATENT DOCUMENTS

| | | | |
|---|---|---|---|
| 2,975,497 | 3/1961 | Budreck | 24/303 |
| 3,111,737 | 11/1963 | Heil | 335/285 |
| 3,144,894 | 8/1964 | Young | 24/3 H |
| 3,192,517 | 6/1965 | Werlin | 335/285 |
| 3,295,575 | 1/1967 | Young | 150/134 |
| 3,326,258 | 6/1967 | Stucker | 24/3 R |
| 3,600,025 | 8/1971 | Brainard | 292/251.5 |
| 3,696,380 | 10/1972 | Murphy | 340/546 |
| 3,986,183 | 10/1976 | Fujiwara | 340/572 |
| 4,121,324 | 10/1978 | Marbacher | 24/303 |
| 4,584,571 | 4/1986 | Smit et al. | 340/572 |

FOREIGN PATENT DOCUMENTS 2202772 7/1973 Fed. Rep. of Germany .

*Primary Examiner*—Victor N. Sakran
*Attorney, Agent, or Firm*—Young & Thompson

[57] ABSTRACT

An arrangement in a purse or a bag secured against theft, for safe-keeping of securtities, with a fastening means for fastening on the inside of a garment (2). Said fastening means consists of a magnet affected body (5), and a permanent magnet (10), and said two members (5, 10) are provided with means (12) for mutual engagement which prevent relative displacement. Said magnet affected body (5) or magnet (10) is fastened to said purse (1). On the purse (1) an electric oscillating circuit is provided comprising a sound generator with a tongue or a diaphragm of a magnet affected material which is provided to be checked against a contact by the aid of the magnetic field of magnet (10) and which automatically generates a signal when the influence from the magnet stops.

3 Claims, 1 Drawing Sheet

ARRANGEMENT IN A PURSE OR BAG SECURED AGAINST THEFT

The present invention relates to an arrangement in a purse or bag that is secured against theft for safe-keeping of securities, with a fastening means for fastening on the inside of a garment.

Theft of money and securities from persons carrying such securities is becoming more and more common. Pickpockets get more and more ingenious, and especially tourists are vulnerable to thefts of money and securities. It may be a question of travel cheques, bank notes, credit cards, and the like, and passports are also much sought-after these days, thousands of passports are stolen and forged to be sold illegally.

It is a problem for tourists and other travellers to keep such securities safe. Often one does not trust any place for safe-keeping at one's temporary living quarters, and as mentioned above, it is hazardious to carry securities about.

There is, thus, an evident demand for a purse or bag secured against theft for keeping such securities, which purse or bag may be carried inside a garment, if desired, in contact with a person's skin. Such purses or bags are known, with the fastening means for securing to the inside of the garment consisting of a means to pierce the garment to be locked by a snap-on or screw-on button outside the garment. In the most simple case the fastening means may be a safety pin or the like. These known means, however, will damage the garment onto which they are secured.

It is an object of the present invention to provide a purse or bag secured against theft of the kind as mentioned above, which may be attached to the inside of a garment without leaving a permanent mark or damaging the garment.

It is a further object of the invention to provide a means which gives a warning in case of unauthorized removal of the purse or bag from the garment it is attached to.

According to the invention this is achieved by a purse or bag that is safe against theft, of the kind mentioned above, and which is characterized in that the fastening means comprises a body that is influenced by a magnet, and a permanent magnet, and that said magnet affected body, and the magnet are provided with means for mutual engagement preventing relative displacement, with either the magnet affected body or the magnet being fastened to the purse.

A further development of the invention is characterized in that associated with the magnet affected body is an electronic oscillating circuit with a sound generator in the shape of a tongue or a diaphragm of a magnet affected material which is movably arranged and is, thus, lockable against a contact by the aid of the magnetic field of said magnet, and which automatically sounds an alarm when the influence of the magnet ends.

Figure 1:
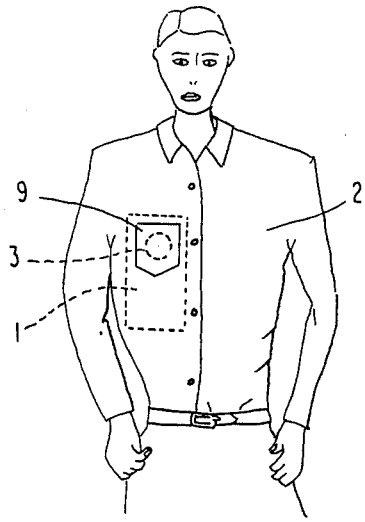
Figure 2:
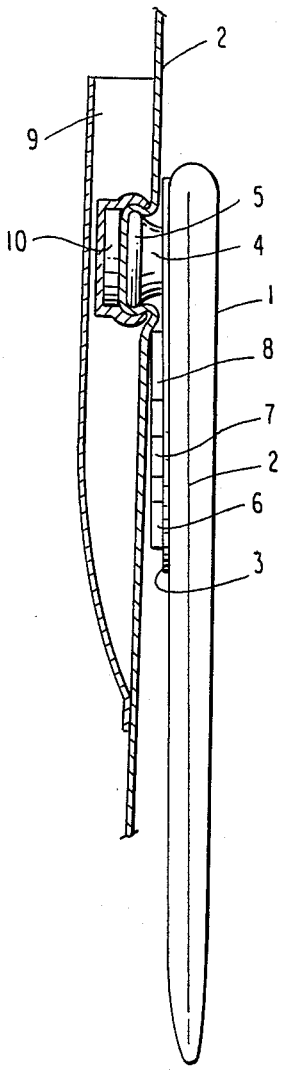
Figure 3:
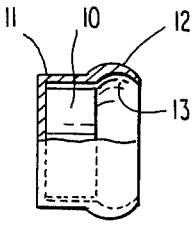

Further features and details of the invention appear from the following description in connection with the drawing, wherein FIG. 1 shows an example of how the bag or purse may be carried, FIG. 2 shows an embodiment of the purse or bag according to the invention, and FIG. 3 shows a partial section of the collar according to the invention.

The purse 1, shown in a dotted line in FIG. 1, is placed on the inside of a person's shirt 2. The purse or bag 1 is made from a soft material, e.g. a textile, to be pliable and comfortable to wear against one's skin and to conform with a garment. The bag has an opening for filling and emptying it and is provided with internal compartments. The opening 2 may be provided with a closure. On the outside surface of the bag a disk 3 is provided. On the outside of the disk there is a button 4 onto the outside of which a disk 5 of a material that is affected by a magnet, e.g. a disk of soft iron is attached. On the disk there is also attached an oscillating circuit with a battery 6, an electronic unit 7, and a signal generator 8. As will appear from FIG. 2, purse 1 may be provided inside shirt 2 in such a manner that button 4 with disk 5 is placed inside an outside pocket 9 of garment 2. In pocket 9 a strong permanent magnet 10 is inserted and is enclosed by a plastic cup 11 extending beyond magnet 10 with a collar 12. Disk 5 has a slightly larger diameter than button 4, so that the disk forms a head. Collar 12 has an undercut portion 13 which may be snapped down over the head formed by disk 5. In this manner a snap fastener-like device is formed. Said snap fastener-like device is, however, not necessary. It is sufficient to provide means to prevent mutual displacement of magnet 10 and disk 5. Such prevention of displacement may consist of a collar without any undercut arrangement.

The sound generator 8 is of the kind having a metallic tongue or a diaphragm which is oscillated when current is conencted with the oscillating circuit. When said tongue or diaphragm is subjected to strong magnetic influence the tongue or magnet is defelcted and checked against an edge so that the signal ends and the current is broken. This is a known device and, thus, does not per se form part of the invention.

The invention is not limited to the embodiment shown in the drawing and described above. Instead of a collar 12, e.g. lugs may be provided along the periphery, or a hole/pin conenction, or the like may be provided. Even though a snap fastener-like shape of disk 5 and cup 11 is advantageous this is not necessary since the magnet per se is so strong that it will form a strong connection with iron disk 5, even when there is textile between the parts. In practice, it will, thus, not be possible to tear the purse from the garment without destroying the latter. If the purse is removed from the magnet in an unauthorized manner, there will automatically be an alarm signal. The electronic circuit may be provided with a delay permitting the user to remove the button, take the purse out of the pocket, and assemble the parts again without any alarm signal being triggered.

I claim:

1. In combination with a garment, a valuable article, and means for securing the valuable article inside the garment against theft, said securing means comprising a button-shaped projection secured to the article, and a cup so shaped as to receive and retain said projection, one of said cup and projection being a permanent magnet and the other of said cup and projection being a magnet-affected body, said projection being disposed within said cup with the material of the garment disposed between said projection and the interior of said cup.

2. The combination of claim 1, in which the projection has a diameter greater than the internal diameter of the rim of the cup, so that a snap fastener effect is created when the projection is introduced into the cup.

3. The combination of claim 1, including an electric oscillating circuit with a signal generating means, said circuit generating an alarm signal when said circuit is separated from said magnet.

* * * * *